US009188134B2

(12) United States Patent
Üre Villoria

(10) Patent No.: US 9,188,134 B2
(45) Date of Patent: Nov. 17, 2015

(54) FLOW MACHINE FOR A FLUID HAVING A RADIAL SEALING GAP AND A STATIONARY WEAR RING

(75) Inventor: Martin Üre Villoria, Turbenthal (CH)

(73) Assignee: Sulzer Management AG, Winterthur (CH)

( * ) Notice: Subject to any disclaimer, the term of this patent is extended or adjusted under 35 U.S.C. 154(b) by 704 days.

(21) Appl. No.: 13/325,421

(22) Filed: Dec. 14, 2011

(65) Prior Publication Data

US 2012/0156012 A1 Jun. 21, 2012

(30) Foreign Application Priority Data

Dec. 16, 2010 (EP) ..... 10195424

(51) Int. Cl.
*F04D 29/12* (2006.01)
*F04D 29/16* (2006.01)
*F04D 29/046* (2006.01)

(52) U.S. Cl.
CPC ..... *F04D 29/167* (2013.01); *F04D 29/12* (2013.01); *F04D 29/0465* (2013.01)

(58) Field of Classification Search
USPC ..... 415/170.1, 172.1, 173.1, 173.3, 174.2, 415/174.3
See application file for complete search history.

(56) References Cited

U.S. PATENT DOCUMENTS

| | | | | |
|---|---|---|---|---|
| 4,421,456 | A * | 12/1983 | Huffman | 415/170.1 |
| 2007/0160467 | A1* | 7/2007 | Lienau et al. | 415/170.1 |
| 2009/0004032 | A1* | 1/2009 | Kaupert | 417/365 |

FOREIGN PATENT DOCUMENTS

| | | | | |
|---|---|---|---|---|
| DE | 35 13 116 | A1 | 10/1986 | |
| DE | 3513116 | A1 * | 10/1986 | F04D 29/08 |
| DE | 35 30 986 | A1 | 3/1987 | |
| FR | 786 795 | A | 9/1935 | |
| GB | 319020 | A | 2/1930 | |
| GB | 1052600 | A | 12/1966 | |

* cited by examiner

*Primary Examiner* — Edward Look
*Assistant Examiner* — Juan G Flores
(74) *Attorney, Agent, or Firm* — Kilpatrick Townsend & Stockton LLP

(57) ABSTRACT

A flow machine 10 for a fluid shown contains a radial sealing gap (9) which is formed between stator parts (4, 4*a*, 4*b*) and a closed impeller (3) of the flow machine, with at least one wear ring (5) arranged in a stationary manner being provided at the sealing gap and having an inner side facing the impeller, an outer side and two axially spaced apart side surfaces. A concentrically extending recess (6) in the form of a radial gap or of a radial incision is formed in the wear ring (5), with the recess 6, starting from one of the side surfaces, extending in the axial direction over more than a fifth of the axial length of the wear ring and with the wear ring (5) being produced from metal, hard metal or a ceramic material.

18 Claims, 3 Drawing Sheets

FLOW MACHINE FOR A FLUID HAVING A RADIAL SEALING GAP AND A STATIONARY WEAR RING

CROSS-REFERENCE TO RELATED APPLICATIONS

Figure 1:
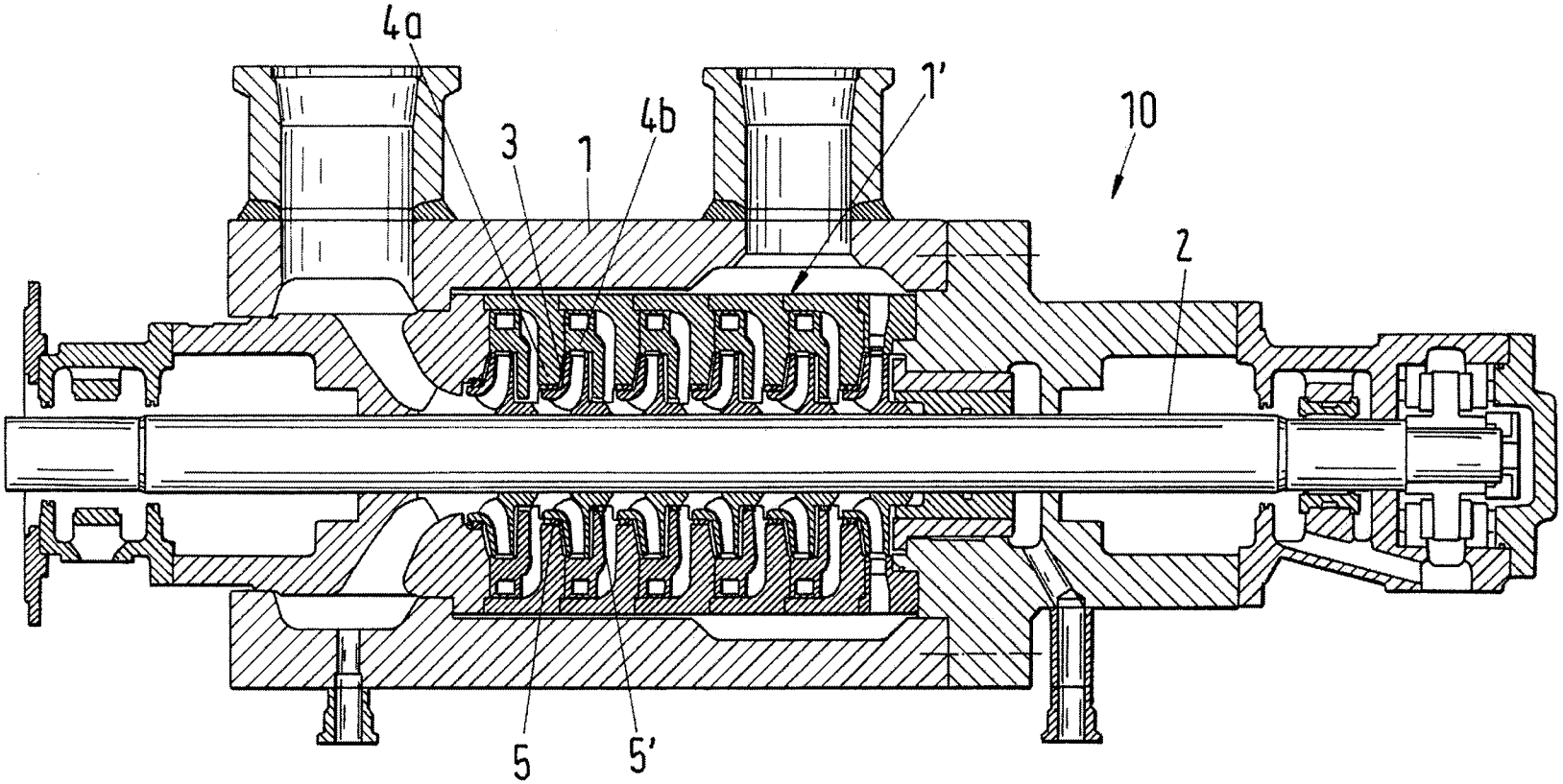

This application claims the priority of European Application No. 10 195 424.6, filed on Dec. 16, 2010, the disclosure of which is incorporated herein by reference.

The invention relates to a flow machine for a fluid having a radial sealing gap and a wear ring arranged in a stationary manner in accordance with the preamble of claim 1 and to a wear ring for such a flow machine in accordance with the preamble of claim 8.

Radial sealing gaps which are normally designed close together to keep the loss flows small are provided between the impellers and the stator parts in flow machines. In applications having an operating pressure of 500 bar and higher, casing deformations occur due to the pressure applied at the outside to the stage casing and/or due to existing axial pressure differences between the individual stage casings, with the stator parts being subjected to a bending load and with noticeable deformations of the stator parts in particular being able to occur in the first and second stages. The deformation of the stator parts in the inlet region of the impellers and in the vicinity of the pump shaft as a rule has the result that the radial sealing gaps narrow in operation and the gap width of the radial sealing gaps is reduced to a fraction of its original size at the narrowest point.

If the impeller and the stator parts come into contact in specific operating states, such as on the start-up of the flow machine, this may result in a premature wear of the stator parts and/or of the impeller and in an unwanted widening of the sealing gaps. If the fluid contains solids, this can likewise result in an increased wear in the narrow sealing gaps. Sealing gaps which hereby become larger impair the efficiency of the flow machine to a considerable extent which cannot be tolerated. A preventive widening of the sealing gaps accordingly also does not represent any economic solution.

If primarily axial deformation phenomena and thus bending loads of the stator part occur in dependence on the embodiment of the flow machine, a widening or reducing clearance arises in the axial direction of the gap. This can result, due to jet effects which are adopted, in unwanted flow phenomena which likewise bring about a deterioration of efficiency. Instabilities of the flow machine characteristics can occur as further negative effects.

To counter an unwanted widening of the sealing gaps, protective layers and/or self-supporting wear rings made from wear-resistant materials are therefore used in the sealing gaps. Such wear rings admittedly have a high wear resistance; however, they can only be manufactured in simple shapes due to their wear resistance. A further disadvantage is the low elasticity of such wear rings. At high pressures, the deformation of the stator parts can have the result that the narrow sealing gap shrinks below a permitted degree or is even bridged, which can result in a premature widening of the sealing gaps or even to damage to the flow machine despite the wear ring.

It is the object of the invention to provide a flow machine for a fluid which includes a radial sealing gap between the stator parts and an impeller and which can be used for operation pressures of 500 bar and higher without a premature widening of the sealing gaps occurring as a consequence of the operating pressure. A further object of the invention is to provide a wear ring for such a flow machine.

This object is satisfied in accordance with the invention by the flow machine defined in claim 1 and by the wear ring defined in claim 8.

The flow machine for a fluid in accordance with the invention contains a radial sealing gap which is formed between stator parts and a closed impeller of the flow machine, with at least one wear ring arranged in a stationary manner being provided at the sealing gap and having an inner side facing the impeller, an outer side and two axially spaced apart side surfaces. A concentrically extending recess in the form of a radial gap or of a radial incision is formed in the wear ring, with the recess, starting from one of the side surfaces, extending in the axial direction over more than a fifth of the axial length of the wear ring and with the wear ring being produced from metal, hard metal or a ceramic material. It is always the total axial length of the wear ring which is in this respect understood by the axial length of the wear ring.

The flow machine can, for example, be a pump, a centrifugal pump or a radial flow pump or a turbine, with the flow machine or the pump or the turbine being able to be designed as required for an operation pressure of more than 240 bar or more than 360 bar.

The wear ring can, for example, be connected to the stator part by means of a shrinking fit or weld connection or solder connection or screw connection or a combination of these connections.

In an advantageous embodiment variant of the flow machine, the outer side of the wear ring is connected to the stator part at the one side, whereas a radial gap, whose axial length is larger than a fourth or larger than a third of the axial length of the wear ring, is formed on the other side of the wear ring in the axial direction between it and the stator part. Typically, the recess in the wear ring starts from that side on which the wear ring is connected at the outside to the stator part.

In a further advantageous embodiment variant of the flow machine, the wear ring, and thus typically also the recess in the wear ring, are arranged at the inlet of the impeller, with the wear ring surrounding the impeller at this point.

The invention further includes a wear ring for a flow machine for a fluid which has a radial sealing gap which is formed between stator parts and a closed impeller, with the wear ring having an inner side facing the impeller in use and an outer side and two axially spaced apart side surfaces and being provided in use for the stationary arrangement at the sealing gap. A concentrically extending recess in the form of a radial gap or of a radial incision is formed in the wear ring, with the recess, starting from one of the side surfaces, extending in the axial direction over more than a fifth of the axial length of the wear ring and with the wear ring being produced from metal, hard metal or a ceramic material. It is always the total axial length of the wear ring which is in this respect understood by the axial length of the wear ring. In an advantageous embodiment, the wear ring is produced from one piece.

The wear ring is typically rotationally symmetrical. In an advantageous embodiment variant, the wear ring is formed cylindrically on the inner side and/or on the outer side. In a further advantageous embodiment variant, the inner side of the wear ring has a surface structure, for example in the form of circumferentially designed grooves or knurlings or honeycomb structures and/or the inner side of the wear ring is ground or polished.

Furthermore, the recess can extend in the axial direction over more than a third or more than half the axial length of the wear ring. The recess is typically rounded in cross-section at the end, for example in the form of a round arc or a semicircle. In a further advantageous embodiment, the wear ring has a reduced length at the outer side.

The material of the wear ring typically has a coefficient of thermal expansion of less than $15\times10^{-6}/°$ C.

The flow machine and the wear ring in accordance with the present invention have the advantage that the elastic behavior of the wear ring can be improved thanks to the recess formed in the wear ring. This is particularly advantageous when the wear ring is produced from a comparatively less elastic material such as hard metal or a ceramic material. Thanks to the improved elastic behavior of the wear ring, radial and axial deformation phenomena are compensated in operation so that the sealing gaps are designed comparatively close together without the deformation of the stator parts at an operating pressure of more than 300 bar having the result that the stator parts and/or the impeller are prematurely worn or even damaged. Furthermore, instabilities in the flow machine characteristics, which occur as a consequence of the radial and axial deformations of the stator parts, can be reduced by the design of the wear rings in accordance with the invention.

The above description of embodiments only serves as an example. Further advantageous embodiments can be seen from the dependent claims and from the drawing. Furthermore, individual features from the embodiments and variants described or shown can also be combined with one another within the framework of the present invention to form new embodiments.

Figure 2:
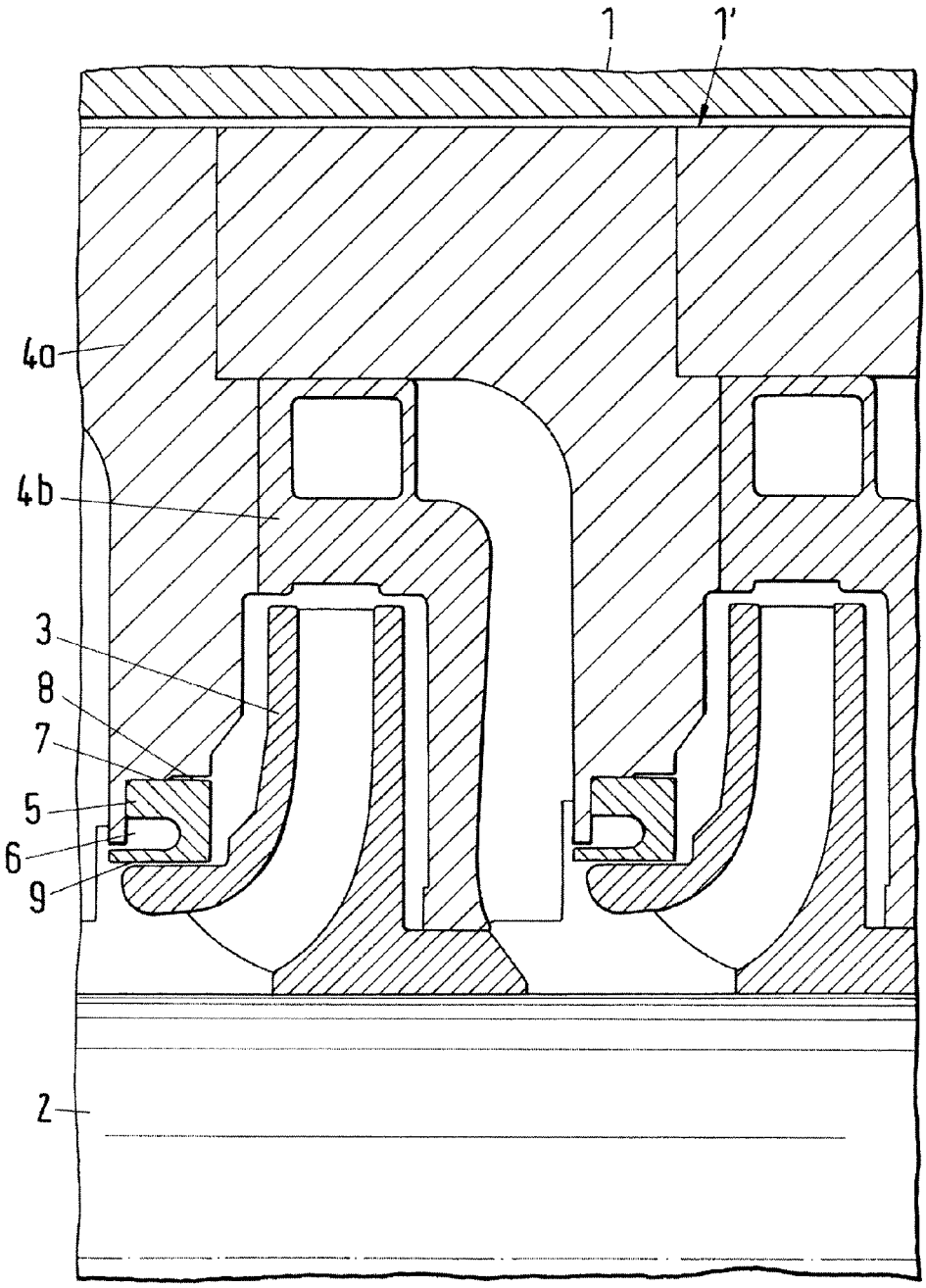
Figure 3:
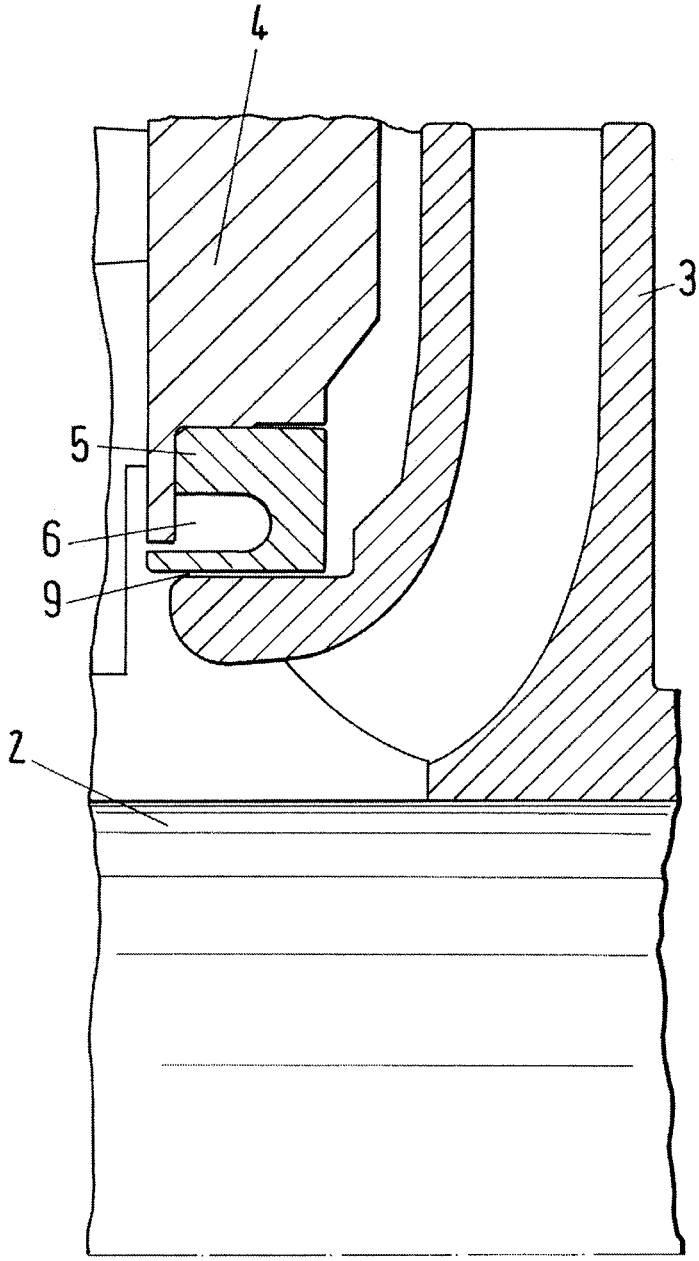

The invention will be explained in more detail in the following with reference to the embodiments and to the drawing. There are shown:

FIG. 1 a longitudinal section through an embodiment of a flow machine in accordance with the present invention;

FIG. 2 a detailed view of an embodiment of a flow machine in accordance with the present invention; and FIG. 3 a detailed view of an embodiment of a wear ring in accordance with the present invention.

FIG. 1 shows a longitudinal section through an embodiment of a flow machine 10 in accordance with the present invention. The flow machine 10 for a fluid shown contains a radial sealing gap 9 which is formed between stator parts 4*a*, 4*b* and a closed impeller 3 of the flow machine, with at least one wear ring 5, 5' arranged in a stationary manner being provided at the sealing gap 9 and having an inner side facing the impeller, an outer side and two axially spaced apart side surfaces. A concentrically extending recess 6 in the form of a radial gap or of a radial incision is formed in the wear ring 5, 5', with the recess 6, starting from one of the side surfaces, extending in the axial direction over more than a fifth of the axial length of the wear ring and with the wear ring 5, 5' being produced from metal, hard metal or a ceramic material.

The flow machine 10 can moreover, as required, contain one or more of the following components: a casing 1, for example, as shown in FIG. 1, a barrel casing, a stage casing 1', guide elements adjoining the flow passages of the impeller 3, a crossover passage between two stages following one another, a shaft 2 on which the impeller or impellers is/are arranged and which is rotatably supported in the casing, seals (not shown in FIG. 1) to seal the shaft 2 with respect to the casing 1, a pump inlet or a pump outlet.

The flow machine 10 can, for example, be a pump, in particular, as shown in FIG. 1, a multi-stage pump, a centrifugal pump or a radial flow pump or a turbine, with the flow machine or the pump or the turbine being able to be designed as required for an operation pressure of more than 240 bar or more than 360 bar.

The wear ring 5, 5' can, for example, be connected to the stator part 4*a*, 4*b* by means of a shrinking fit or weld connection or solder connection or screw connection or a combination of these connections.

In a further advantageous embodiment variant of the flow machine 10, the wear ring 5, 5', and thus typically also the recess 6 in the wear ring, are arranged at the inlet of the impeller 3, with the wear ring surrounding the impeller at this point.

Further advantageous embodiments of the flow machine 10 will be explained in the following in connection with the description of FIG. 2. Possible embodiment variants of the wear ring 5, 5' will be looked at in connection with the description of FIG. 3.

FIG. 2 shows a detailed view of an embodiment of a flow machine 10 in accordance with the present invention. The flow machine for a fluid shown in a detailed view contains a radial sealing gap 9 which is formed between the stator parts 4*a*, 4*b* and a closed impeller 3 of the flow machine, with at least one wear ring 5, arranged in a stationary manner, being provided at the sealing gap 9 and having an inner side facing the impeller, an outer side and two axially spaced apart side surfaces. A concentrically extending recess 6 in the form of a radial gap or of a radial incision is formed in the wear ring 5, with the recess 6, starting from one of the side surfaces, extending in the axial direction over more than a fifth of the axial length of the wear ring and with the wear ring 5 being produced from metal, hard metal or a ceramic material.

The flow machine 10 can moreover, as required, contain one or more of the following components: a casing 1, for example a barrel casing, a stage casing 1', a shaft 2 on which the impeller or impellers is/are arranged and which is rotatably supported in the casing, or seals (not shown in FIG. 2) to seal the shaft 2 with respect to the casing 1.

The flow machine 10 can, for example, be a pump, in particular, as shown in FIG. 2, a multi-stage pump, a centrifugal pump or a radial flow pump or a turbine, with the flow machine or the pump being able to be designed as required for an operation pressure of more than 240 bar or more than 360 bar.

The wear ring 5 can, for example, be connected to the stator part 4*a*, 4*b* by means of a shrinking fit or weld connection or sold connection or screw connection or a combination of these connections.

In an advantageous embodiment variant of the flow machine 10, the outer side 7 of the wear ring 5 is connected to the stator part 4*a*, 4*b* at the one side, whereas a radial gap 8, whose axial length is larger than a fourth or larger than a third of the axial length of the wear ring, is formed on the other side of the wear ring in the axial direction between it and the stator part. Typically, the recess 6 in the wear ring 5 starts from that side on which the wear ring is connected at the outside to the stator part.

In a further advantageous embodiment variant of the flow machine 10, the wear ring 5, and thus typically also the recess 6 in the wear ring, are arranged at the inlet of the impeller 3, with the wear ring surrounding the impeller at this point. If required, a wear-resistant protective layer can be provided on the cover plate of the impeller, said cover plate forming the sealing gap 9 together with the wear ring 5 or, if the fluid to be conveyed, for example, contains abrasive solids, a wear ring can be provided which is fastened to the impeller.

The recess 6 of the wear ring 5 is advantageously covered at least in part by the stator part 4*a*, 4*b*.

Possible embodiment variants of the wear ring 5 will be looked at in connection with the description of FIG. 3.

FIG. 3 shows a detailed view of an embodiment of a wear ring in accordance with the present invention in the installed state. The wear ring 5 in accordance with the invention for a flow machine for a fluid which has a radial sealing gap 9 which is formed between stator parts 4 and a closed impeller 3 has an inner side facing the impeller in use, an outer side and two axially spaced apart side surfaces and is provided for stationary arrangement at the sealing gap 9 in use. A concentrically extending recess 6 in the form of a radial gap or of a radial incision is formed in the wear ring 5, with the recess 6, starting from one of the side surfaces, extending in the axial direction over more than a fifth of the axial length of the wear ring, and with the wear ring 5 being produced from metal, hard metal or a ceramic material, for example from a wear-resistant material such as nitride hardened cast steel or a ceramic material which can, for example, contain metal oxides, tungsten carbide or silicon carbide. The material of the wear ring typically has a coefficient of thermal expansion of less than $15\times10^{-6}/°$ C. In an advantageous embodiment, the wear ring 5 is produced from one piece.

The wear ring 5 is typically rotationally symmetrical. In an advantageous embodiment variant, the wear ring 5 is formed cylindrically on the inner side and/or on the outer side. In a further advantageous embodiment variant, the inner side of the wear ring 5 has a surface structure, for example in the form of circumferentially designed grooves or knurlings or honeycomb structures and/or the inner side of the wear ring 5 is ground or polished.

Furthermore, the recess 6 can extend in the axial direction over more than a third or more than half the axial length of the wear ring. The recess 6 usually has an inner wall and an outer wall which can, for example, extend parallel to the axis of the wear ring. The recess 6 is typically rounded in cross-section at the end, for example in the form of a round arc or a semicircle. In a further advantageous embodiment, the wear ring 5 is shorter on the outer side 7 than on the inner side.

Thanks to the recess formed in the wear ring, the elastic behavior thereof is improved and the sealing gap between the wear ring arranged in a stationary manner and the impeller can accordingly be designed more closely together than would be possible without a recess. It is thus possible to design the sealing gaps for an ideal efficiency and to provide an economic flow machine in which the wear of the impeller and/or of the stator parts or of the wear ring is lower at an operating pressure of more than 300 bar than in conventional flow machines for this pressure range.

The invention claimed is:

1. A flow machine for a fluid having a radial sealing gap which is formed between stator parts and a closed impeller, wherein the flow machine is designed for an operating pressure of more than 240 bar, with at least one wear ring arranged in a stationary manner being provided at the sealing gap and having an inner side facing the impeller, an outer side and two axially spaced apart side surfaces, characterized in that a concentrically extending recess is formed in the wear ring in the form of a radial gap or of a radial incision; in that the recess, starting from one of the side surfaces, extends in the axial direction over more than a fifth of the axial length of the wear ring; and in that the wear ring is produced from metal, hard metal or ceramic material, wherein the outer side of the wear ring is connected on the one side directly to the stator part and a radial gap whose axial length is larger than a fourth or larger than a third of the axial length of the wear ring is formed on the other side of the wear ring in the axial direction between it and the stator part.

2. The flow machine in accordance with claim 1, wherein the flow machine is a pump or a centrifugal pump or a radial flow pump.

3. The flow machine in accordance with claim 1, wherein the flow machine or pump is designed for an operating pressure of more than 360 bar.

4. The flow machine in accordance with claim 1, wherein the wear ring is connected to the stator part on the one side by any one or more of a shrunk fit, weld connection, solder connection, and screw connection.

5. The flow machine in accordance with claim 1, wherein the recess in the wear ring starts from that side on which the wear ring is connected at the outside to the stator part.

6. The flow machine in accordance with claim 1, wherein the wear ring is arranged at the inlet of the impeller and surrounds it at this point.

7. A wear ring for a flow machine for a fluid, which is designed for an operating pressure of more than 240 bar, and which has a radial sealing gap which is formed between stator parts and a closed impeller, with the wear ring having an inner side facing the impeller in use, an outer side and two axially spaced apart side surfaces and being provided for stationary arrangement at the sealing gap in use, characterized in that a concentrically extending recess in the form of a radial gap or of a radial incision is provided in the wear ring; in that the recess, starting from one of the side surfaces, extends in the axial direction over more than a fifth of the axial length of the wear ring; and in that the wear ring is produced from metal, hard metal or ceramic material, wherein the outer side of the wear ring is configured to be directly connected on the one side to the stator part and further configured such that a radial gap whose axial length is larger than a fourth or larger than a third of the axial length of the wear ring is formed on the other side of the wear ring in the axial direction between it and the stator part.

8. The wear ring in accordance with claim 7, wherein the wear ring is made from one piece.

9. The wear ring in accordance with claim 7, wherein the wear ring is rotationally symmetrical.

10. The wear ring in accordance with claim 7, wherein the wear ring is formed cylindrically on the inner side and/or on the outer side.

11. The wear ring in accordance with claim 7, wherein the recess extends in the axial direction over more than a third or more than half the axial length of the wear ring.

12. The wear ring in accordance with claim 7, wherein the wear ring has a reduced length at the outer side.

13. The wear ring in accordance with claim 7, wherein the inner side of the wear ring has a surface structure.

14. The wear ring in accordance with claim 7, wherein the material of the wear ring has a coefficient of thermal expansion of less than $15\times10^{-6}/°$ C.

15. The wear ring in accordance with claim 13, wherein the surface structure is any one or more of circumferentially designed grooves, knurlings, and honeycomb structures.

16. The wear ring in accordance with claim 7, wherein inner side of the wear ring is ground or polished.

17. A flow machine for a fluid, comprising:

at least one stator part;

a closed impeller;

a radial sealing gap between the stator part and the impeller;

a wear ring disposed in the sealing gap and having an inner side comprising an inner side surface facing the impeller, and an outer side comprising an outer side surface opposite and axially spaced apart from the inner side surface, wherein the wear ring comprises a concentrically extending recess defining an additional radial gap, wherein the recess extends from the inner side surface or the outer side surface of the wear ring in an axial direction over more than a fifth of an axial length of the wear ring, wherein the wear ring comprises metal, hard metal, or ceramic material, wherein the outer side of the wear ring abuts the stator part and is fixedly attached to the stator part, and wherein the inner side of the wear ring is spaced apart from the stator part by a radial gap, wherein the radial gap comprises an axial length which is larger than a fourth of the axial length of the wear ring.

18. The flow machine in accordance with claim 17, wherein the outer side of the wear ring is fixedly attached to the stator part by any one or more of:

a shrunk fit directly between the stator part and the outer side of the wear ring, a weld connection directly between the stator part and the outer side of the wear ring, a solder connection directly between the stator part and the outer side of the wear ring, and a screw connection directly between the stator part and the outer side of the wear ring.

* * * * *